US007570133B1

(12) United States Patent
Taft et al.

(10) Patent No.: US 7,570,133 B1
(45) Date of Patent: Aug. 4, 2009

(54) WIDEBAND PASSIVE AMPLITUDE COMPENSATED TIME DELAY MODULE

(75) Inventors: William J. Taft, Yardville, NJ (US); Joseph Alfred Iannotti, Glenville, NY (US); Christopher James Kapusta, Delanson, NY (US); Anthony W. Jacomb-Hood, Yardley, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 195 days.

(21) Appl. No.: 11/634,107

(22) Filed: Dec. 6, 2006

Related U.S. Application Data

(60) Provisional application No. 60/784,808, filed on Mar. 23, 2006.

(51) Int. Cl.
*H01P 3/00* (2006.01)
*H01P 9/00* (2006.01)

(52) U.S. Cl. ..... 333/164; 333/156; 333/161

(58) Field of Classification Search ..... 333/156, 333/161, 164
See application file for complete search history.

(56) References Cited

U.S. PATENT DOCUMENTS 4,614,921 A * 9/1986 Yarman ..... 333/139
4,994,773 A * 2/1991 Chen et al. ..... 333/164
5,109,449 A * 4/1992 Newberg et al. ..... 385/46
5,424,696 A * 6/1995 Nakahara et al. ..... 333/156
5,576,671 A * 11/1996 Agar et al. ..... 333/128
5,663,736 A * 9/1997 Webb et al. ..... 342/375
5,703,708 A * 12/1997 Das et al. ..... 398/102
6,542,051 B1 * 4/2003 Nakada ..... 333/164
6,674,341 B2 * 1/2004 Hieda et al. ..... 333/164
7,332,983 B2 * 2/2008 Larson ..... 333/161
7,355,492 B2 * 4/2008 Hyman et al. ..... 333/164
2004/0155728 A1 * 8/2004 Cheung et al. ..... 333/161
2005/0012564 A1 * 1/2005 Schoebel ..... 333/164

* cited by examiner

*Primary Examiner*—Vibol Tan
*Assistant Examiner*—Jason Crawford
(74) *Attorney, Agent, or Firm*—McDermott Will & Emery LLP

(57) ABSTRACT

A true time delay ("TTD") system with wideband passive amplitude compensation is provided. The TTD system includes an input switch, an output switch, a reference delay line disposed between the input switch and the output switch, and time delay lines disposed between the input switch and the output switch. Each time delay line ("TDL") has a different line length, and includes a center conductor between two corresponding ground planes. Each center conductor has a width and is separated from the two corresponding ground planes by a gap space. For each TDL, the width of the center conductor is configured such that a loss of the TDL is substantially the same as a loss of every other TDL over a range of operating frequencies. For each TDL, the gap space is configured such that an impedance of the TDL is substantially the same as an impedance of every other TDL.

19 Claims, 7 Drawing Sheets

WIDEBAND PASSIVE AMPLITUDE COMPENSATED TIME DELAY MODULE

CROSS-REFERENCE TO RELATED APPLICATION

The present application claims the benefit of priority under 35 U.S.C. § 119 from U.S. Provisional Patent Application Ser. No. 60/784,808 entitled "WIDEBAND PASSIVE AMPLITUDE COMPENSATED LONG TIME DELAY MODULE," filed on Mar. 23, 2006, the disclosure of which is hereby incorporated by reference in its entirety for all purposes.

STATEMENT REGARDING FEDERALLY SPONSORED RESEARCH OR DEVELOPMENT

Not applicable.

FIELD OF THE INVENTION

The present invention generally relates to true time delay ("TTD") modules and, in particular, relates to wideband passive amplitude compensated TTD modules.

BACKGROUND OF THE INVENTION

According to one approach, beamformers utilize phase shifters or active true time delay modules. As opposed to beamformers utilizing phase shifters, beamformers utilizing active TTD modules are able to steer and maintain a beam's position independent of frequency, thereby avoiding undesirable beam "squint.".

Active TTD modules, however, tend to experience two serious disadvantages when compared to phase shifters. First, active TTD modules tend to have higher insertion loss when implemented with MMIC technologies, as a result of their higher line RF losses. Second, due to these higher line losses, the loss imbalance between the various TTD states can vary considerably with frequency, requiring frequency-dependent amplitude imbalance correction for each state and the concomitant extra electronics needed to correct these issues within an array beamformer. The performance and cost impacts due to these issues usually renders active TTD modules impracticable for use in phased array architectures.

The present invention overcomes these limitations and deficiencies and provides other advantages as well.

SUMMARY OF THE INVENTION

In accordance with the present invention, a true time delay ("TTD") system with wideband passive amplitude compensation is provided. The TTD system includes a plurality of time delay lines of different lengths. The geometry of each time delay line is configured so that the insertion loss and characteristic impedance thereof is substantially the same as every other time delay line.

According to one embodiment of the present invention, a true time delay system includes a multi-throw input switch, a multi-throw output switch, a reference delay line disposed between the multi-throw input switch and the multi-throw output switch, and a plurality of time delay lines disposed between the multi-throw input switch and the multi-throw output switch. Each of the plurality of time delay lines has a different line length, and each of the plurality of time delay lines includes one or more corresponding ground planes and a center conductor having a width and being separated from the one or more corresponding ground planes by one or more corresponding gap spaces. For each of the plurality of time delay lines, the width of the center conductor is configured such that a loss of the time delay line is substantially the same as a loss of every other time delay line over a range of operating frequencies. For each of the plurality of time delay lines, the gap space is configured such that an impedance of the time delay line is substantially the same as an impedance of every other time delay line.

According to another embodiment of the present invention, a true time delay system includes a multi-throw input switch, a multi-throw output switch, a zero delay line disposed between the multi-throw input switch and the multi-throw output switch, and a plurality of time delay lines disposed between the multi-throw input switch and the multi-throw output switch. Each of the plurality of time delay lines has a different line length, and each of the plurality of time delay lines includes two corresponding ground planes and a center conductor between the two corresponding ground planes. Each center conductor has a width and is separated from the two corresponding ground planes by a gap space. For each of the plurality of time delay lines, the width of the center conductor is configured such that a loss of the time delay line is substantially the same as a loss of every other time delay line over a range of operating frequencies. For each of the plurality of time delay lines, the gap space is configured such that an impedance of the time delay line is substantially the same as an impedance of every other time delay line.

According to another embodiment of the present invention, a beamformer for wideband phased array applications includes at least one true time delay module with passive amplitude compensation. The at least one true time delay module includes a multi-throw input switch, a multi-throw output switch, a reference delay line disposed between the multi-throw input switch and the multi-throw output switch, and a plurality of time delay lines disposed between the multi-throw input switch and the multi-throw output switch. Each of the plurality of time delay lines has a different line length, and each of the plurality of time delay lines includes two corresponding ground planes and a center conductor between the two corresponding ground planes. Each center conductor has a width and is separated from the two corresponding ground planes by a gap spacing. For each of the plurality of time delay lines, the width of the center conductor is configured such that a loss of the time delay line is substantially the same as a loss of every other time delay line over a range of operating frequencies. For each of the plurality of time delay lines, the gap spacing is configured such that an impedance of the time delay line is substantially the same as an impedance of every other time delay line.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

TTD modules consist of multi-throw input and output switches that select one of many transmission lines (implemented as either lumped elements or distributed elements) of various physical lengths. Since the propagation velocity of a signal in each transmission line is the same, each line length represents a distinct time path. Since the loss per unit length of the transmission lines (or "time delay lines") tends to be the same, the fact that the lines are different lengths means the signal loss for each line is different. In active TTD modules, compensation for these loss variations is accomplished by using discrete amplifiers or attenuators in-line with each transmission line to provide loss/gain matching between all the transmission lines. The gain/loss of each amplifier or attenuator must compensate over the required frequency band for the loss of the associated delay line as a function of frequency. This requires customized amplifier/attenuator designs for each delay path, increasing the cost and complexity of the active TTD module. An alternative approach is to place a variable attenuator or variable gain amplifier in series with the active TTD module. This provides a narrow band correction, which may be acceptable in some applications.

Figure 1:
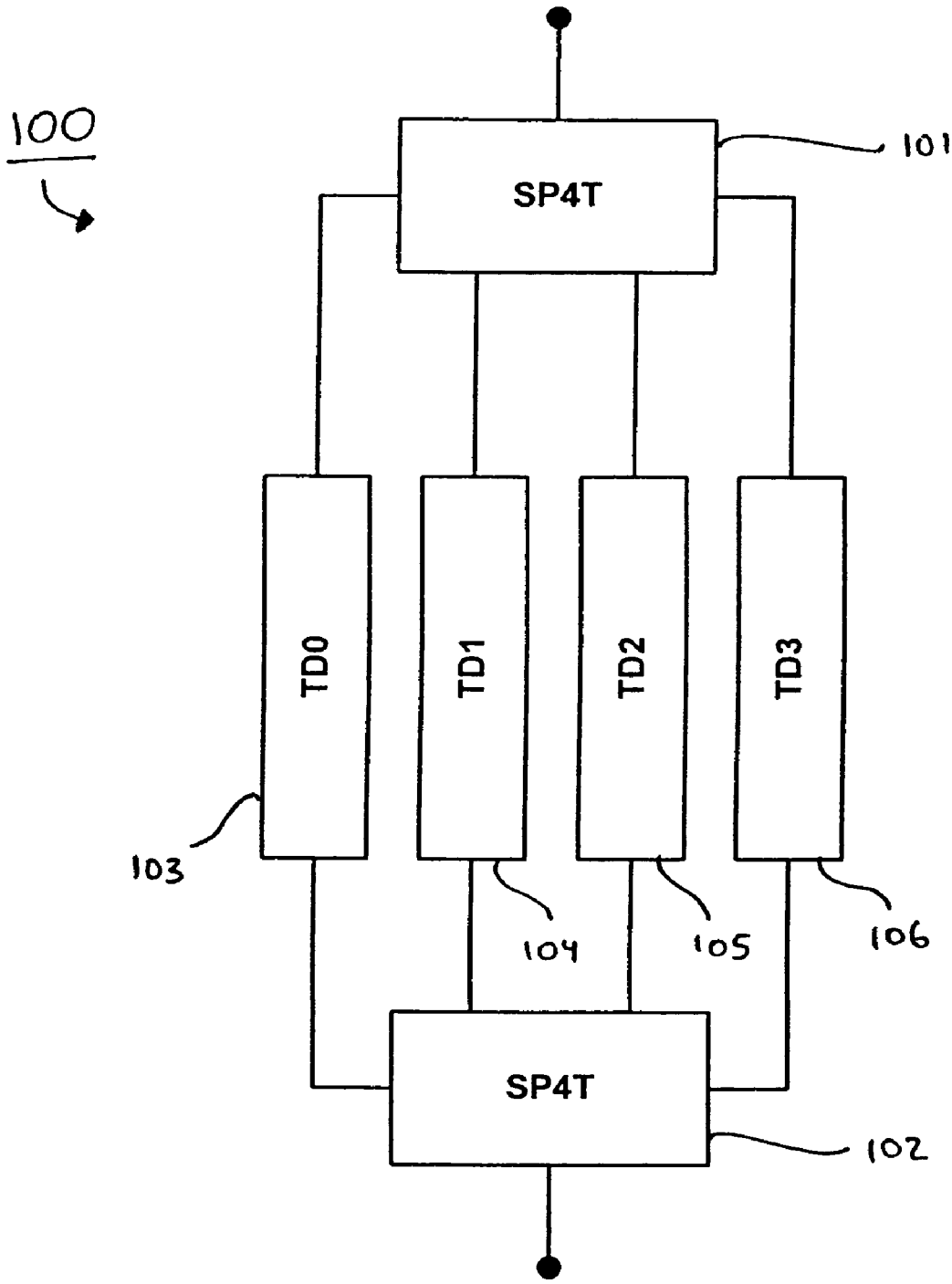
FIG. 1 is a block diagram illustrating a wideband passive amplitude compensated TTD system according to one embodiment of the present invention.

The present invention overcomes the limitations of active TTD modules by providing a TTD system with wideband passive amplitude compensation that is simple to implement. FIG. 1 is a block diagram illustrating a 2 bit wideband passive amplitude compensated TTD system according to one embodiment of the present invention. TTD system 100 includes a multi-throw input switch 101 and a multi-throw output switch 102, between which are disposed four transmission lines: one reference delay line 103 and three time delay lines 104, 105 and 106. Each transmission line has a different physical length, representing a different time delay value. For example, in the present exemplary embodiment, reference delay line 103 has a time delay value of 10 picoseconds (ps), time delay line 104 has a time delay value of 330 ps (representing a delay of 320 ps relative to reference delay line 103), time delay line 105 has a time delay value of 650 ps (representing a delay of 640 ps relative to reference delay line 103), and time delay line 106 has a time delay value of 970 ps (representing a delay of 960 ps relative to reference delay line 103). The geometry of each time delay line is configured so that despite the differing physical lengths of each time delay line, the insertion loss and characteristic impedance thereof is substantially the same as every other time delay line, as is described more fully below. Additionally, the design of reference delay line 103 is such that the insertion loss is substantially the same as the time delay lines, while maintaining a good impedance match.

Figure 2:
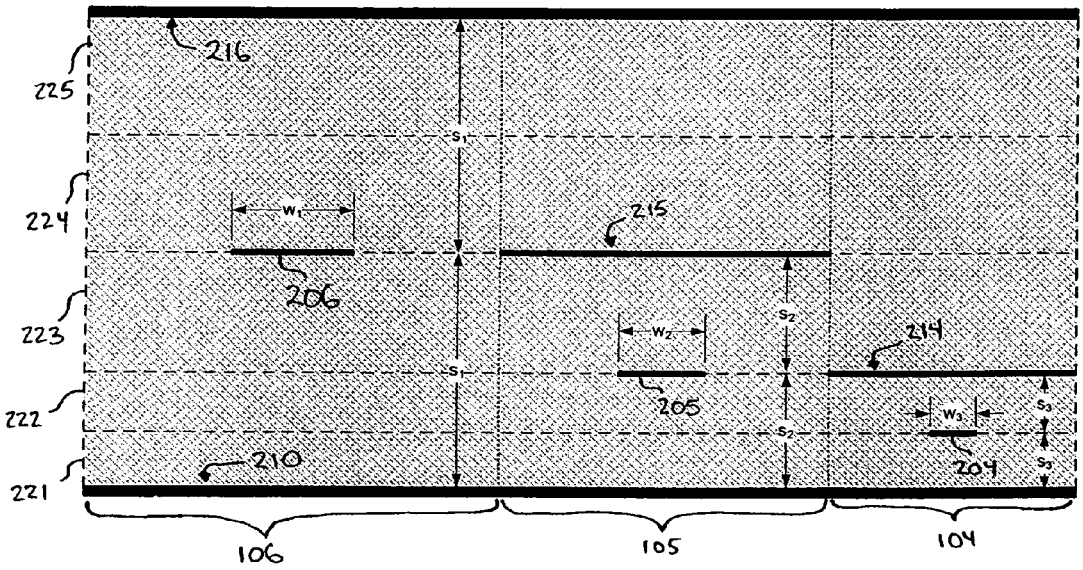
FIG. 2 illustrates in cross section several time delay lines in a high density interconnect stripline configuration according to one embodiment of the present invention.

According to one embodiment of the present invention, time delay lines 104, 105 and 106 may be implemented as high density interconnect ("HDI") striplines. FIG. 2 illustrates such an embodiment, in which time delay lines 104, 105 and 106 are illustrated in cross section. Time delay line 106 includes center conductor 206 and parallel ground planes 210 and 216. Between ground planes 210 and 216 are disposed layers 221-225 of dielectric material. Center conductor 206 is disposed approximately equidistant from ground planes 210 and 216 (i.e., with a gap space of about $s_1$ from each of ground planes 210 and 216). Time delay line 105 includes center conductor 205 and ground planes 210 and 215, between which are disposed layers 221-223 of dielectric material. Center conductor 205 is disposed approximately equidistant from ground planes 210 and 215 (i.e., with a gap space of about $s_2$ from each of ground planes 210 and 215). Time delay line 104 includes center conductor 204 and ground planes 210 and 214, between which are disposed layers 221 and 222 of dielectric material. Center conductor 204 is disposed approximately equidistant from ground planes 210 and 214 (i.e., with a gap space of about $s_3$ from each of ground planes 210 and 214).

The width $w_1$ of center conductor 206 is greater than the widths $w_2$ and $w_3$ of the center conductors 205 and 204 of time delay lines 105 and 104, respectively. As the cross-sectional area of center conductor 206 is larger than that of center conductors 205 and 204, the loss per unit length of time delay line 106 is correspondingly lower than that of time delay lines 105 and 104. Similarly, the width $w_2$ of center conductor 205 is greater than the width $w_3$ of center conductor 204 of time delay line 104. The width of each center conductor is chosen so that, given the length of the corresponding time delay line, the overall insertion loss of all the time delay lines is approximately the same. For example, the width $w_1$ of center conductor 206 is chosen such that, given the length of time delay line 106 (i.e., long enough to provide a 970 ps delay), the overall insertion loss of time delay line 106 can be matched with that of time delay lines 104 and 105.

If the only difference between time delay lines 104, 105 and 106 were the width of their center conductors, the characteristic impedance of each time delay line would vary, resulting in undesirable signal loss and reflections. Accordingly, to match the impedance of each time delay line, the ratio of center conductor width (w) to ground plane spacing (2s) is maintained approximately the same for each of the time delay lines by increasing the gap space for the wider center conductors (i.e., $w_1/2s_1 \approx w_2/2s_2 \approx w_3/2s_3$). For example, according to one exemplary experimental embodiment, the values illustrated in Table 1 were chosen to ensure a good impedance match between the various time delay lines:

TABLE 1

| | w | s | w/2s |
|---|---|---|---|
| TD1 | 40 μm | 25 μm | 0.80 |
| TD2 | 81 μm | 50 μm | 0.81 |
| TD3 | 159 μm | 100 μm | 0.795 |

The high density interconnect ("HDI") structure permits this impedance matching to be accomplished with relative ease. As can be seen with reference to FIG. 2, center conductor 204 is sandwiched between two layers 221 and 222 of dielectric material of the same thickness (e.g., a 25 μm sheet of Kapton®). Not shown for clarity in FIG. 2 is a thin layer of adhesive between layers 221 and 222, in which center conductor 204 is disposed. An additional layer 223 of dielectric material, approximately twice the thickness of either one of layer 221 and 222 (e.g., a 50 μm sheet of Kapton®) is used to sandwich center conductor 205 against layer 222. Again, center conductor 205 is disposed in a thin layer of adhesive (e.g., about 14 μm thick) which is not shown in FIG. 2 for clarity. Center conductor 206 is similarly situated, with an additional two layers 224 and 225 of dielectric material providing the gap space $s_1$ between ground plane 216 and center conductor 206.

In addition to simplifying the fabrication of the time delay lines, this arrangement permits the direct integration of the loss-matched time delay lines with semiconductor RF switches such as switches 101 and 102, to provide miniature, multi-beam wideband phased arrays. Additionally, the off-chip HDI implementation of time delay lines 104-106 reduces the amount of semiconductor real estate required, when compared with microwave monolithic integrated circuit ("MMIC") TTD modules, providing a substantial cost advantage to a TTD module of the present invention.

According to an additional aspect of the present invention, time delay lines can be implemented either on-chip or off-chip, to accommodate various design goals or constraints. Using off-chip time delay lines provides lower absolute line loss for all of the time delay lines, thereby reducing the overall array circuit loss.

One important benefit of the present invention is that time delay lines 104, 105 and 106 can be configured such that the insertion loss for each time delay line is substantially the same as every other time delay line over a broad range of operating frequencies. For example, according to the exemplary experimental embodiment discussed above with reference to Table 1, the insertion loss of the various time delay lines varied by about ±1.0 dB in a range of operating frequencies from 2 to 18 GHz. This was accomplished while maintaining substantially the same characteristic impedance for every time delay line. For example, according to the present exemplary experimental embodiment, the characteristic impedance of the various time delay lines varied by no more than ±10% (i.e., with a voltage standing wave ratio of less than about 1.1).

Figure 3:
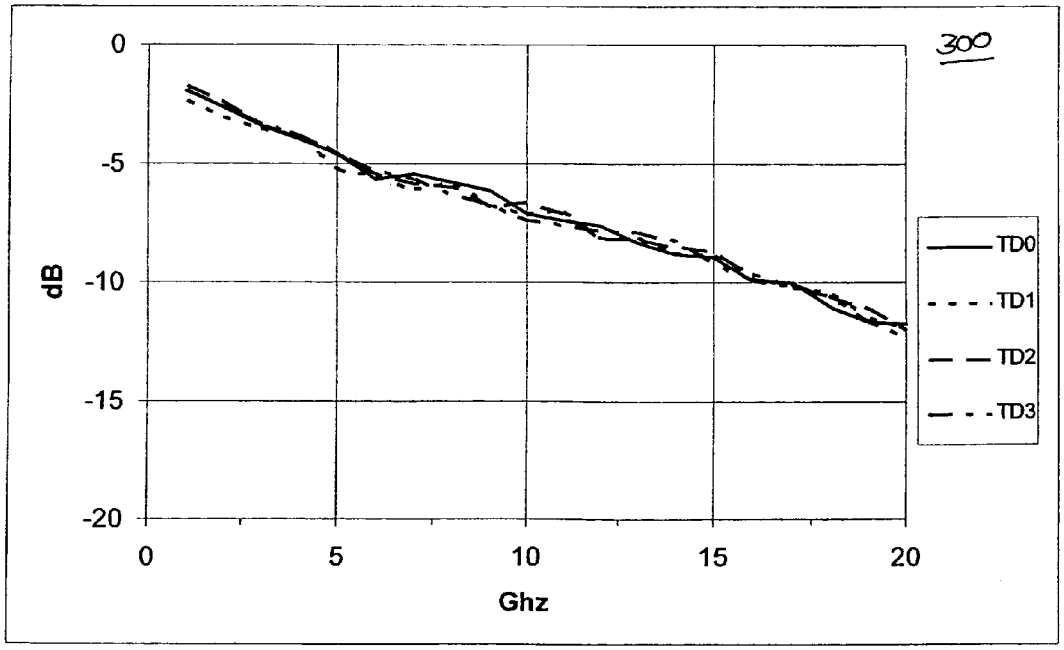
FIG. 3 is a graph illustrating an advantage of a true time delay module in accordance with one aspect of the present invention.

The advantage in wideband passive amplitude compensation of this exemplary embodiment of the present invention is illustrated in FIG. 3. Graph 300 illustrates the insertion losses of reference delay line 103 ("TD0") and time delay lines 104, 105 and 106 ("TD1," "TD2" and "TD3," respectively). As can be seen with reference to graph 300, the insertion loss of each of time delay lines 104, 105 and 106 varies by less than about ±1.0 dB in a range of operating frequencies from 2 to 18 GHz.

While the above exemplary embodiments have been described with reference to layers of Kapton®, the scope of the present invention is not limited to such an arrangement. Rather, as will be apparent to one of skill in the art, layers 221-225 may be any one of a number of dielectric materials known to those of skill in the art, including polyimide films and the like.

While the foregoing exemplary embodiments have been illustrated with symmetric striplines, the scope of the present invention is not limited to such an arrangement. Rather, as will be apparent to one of skill in the art, a transmission line of the present invention may be asymmetric, including layers of various thicknesses. Such an embodiment will provide additional design freedom for equalizing the loss v. frequency curves of various time delay lines in a TTD module.

While the above exemplary embodiments have been described with reference to 2-bit time delay modules having four transmission lines, the scope of the present invention is not limited to such an arrangement. Rather, as will be apparent to one of skill in the art, a time delay module of the present invention may include any number of transmission lines, whether in factors of 2 (e.g., 2, 4, 8, 16, etc.) or not (e.g., 3, 5, 6, 7, etc.)

Figure 4:
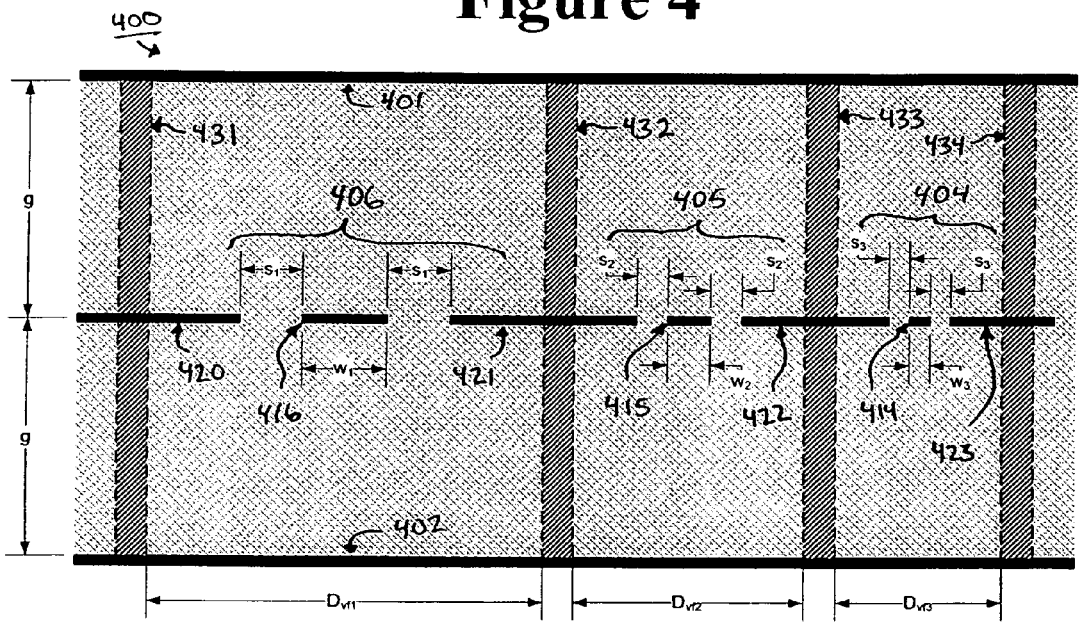
FIG. 4 illustrates in cross section several time delay lines in a coplanar waveguide configuration according to one embodiment of the present invention.

According to another embodiment of the present invention, a time delay module of the present invention may include time delay lines implemented as coplanar waveguides. FIG. 4 illustrates a partial view of one such embodiment, in which time delay lines 404-406 are illustrated in cross-section. True time delay module 400 includes stripline ground planes 401 and 402, which are connected to each other by via fences 431-434. True time delay module 400 further includes time delay lines 404-406. Time delay line 406 includes center conductor 416 and coplanar ground planes 420 and 421. Center conductor 416 is disposed approximately equidistant from ground planes 420 and 421 (i.e., with a gap space of about $s_1$ from each of ground planes 420 and 421). Ground planes 420 and 421 are commonly grounded with stripline ground planes 401 and 402 by via fences 431 and 432, respectively. Time delay line 405 includes center conductor 415 disposed approximately equidistant between ground planes 421 and 422 (i.e., with a gap space of about $s_2$ from each of ground planes 421 and 422). Ground plane 422 is commonly grounded with stripline ground planes 401 and 402 by via fence 433. Time delay line 404 includes center conductor 414 disposed approximately equidistant between ground planes 422 and 423 (i.e., with a gap space of about $s_3$ from each of ground planes 422 and 423). Ground plane 423 is commonly grounded with stripline ground planes 401 and 402 by via fence 434.

Similarly to the embodiment illustrated in FIG. 2, the width $w_1$ of center conductor 416 is greater than the widths $w_2$ and $w_3$ of the center conductors 415 and 414 of time delay lines 405 and 404, respectively. As the cross-sectional area of center conductor 416 is larger than that of center conductors 415 and 414, the loss per unit length of time delay line 406 is correspondingly lower than that of center conductors 405 and 404. Similarly, the width $w_2$ of center conductor 415 is greater than the width $w_3$ of center conductor 414 of time delay line 404. The width of each center conductor is chosen so that, given the length of the corresponding time delay line, the overall insertion loss of all the time delay lines is approximately the same. For example, the width $w_1$ of center conductor 416 is chosen such that, given the length of time delay line 406 (i.e., long enough to provide a 970 ps delay), the overall insertion loss of time delay line 406 can be matched with that of time delay lines 404 and 405.

To ensure that the characteristic impedance of each time delay line is well matched, in accordance with one embodiment of the present invention, the ratio of center conductor width (w) to ground plane spacing (2s+w) is maintained approximately the same for each of the time delay lines by increasing the gap space for the wider center conductors (i.e., $w_1/(2s_1+w_1)\approx w_2/(2s_2+w_2)\approx w_3/(2s_3+w_3)$). Additionally, to ensure that each time delay line functions in a coplanar waveguide ("CPW") mode, in accordance with one embodiment of the present invention, the space (2g) between the outer ground planes 401 and 402 is more than twice the space between the two corresponding ground planes of each time delay line. For example, for time delay line 406, the stripline ground plane spacing, 2g is greater than $2(w_1+2s_1)$. Moreover, to avoid undesirable cavity moding, in accordance with one embodiment of the present invention, the via fences surrounding each time delay line are spaced closer than half the wavelength of a wave propagating in the coplanar waveguide at the maximum frequency.

While the foregoing exemplary embodiments have been described with reference to symmetric coplanar waveguide transmission lines, the scope of the present invention is not limited to such an arrangement. Rather, as will be apparent to one of skill in the art, a transmission line of the present invention may be asymmetric (e.g., having a center conductor with unequal gap space on either side).

While the present invention has been described above with reference to particular time delay line lengths and operating frequencies (e.g., 10 ps, 330 ps, 2-18 GHz, etc.), the scope of the present invention is not limited to the particular arrangements described above. Rather, as will be apparent to one of skill in the art, the present invention has application to true time delay modules with time delay lines of any length, and with operating ranges including any frequencies.

Figure 5:
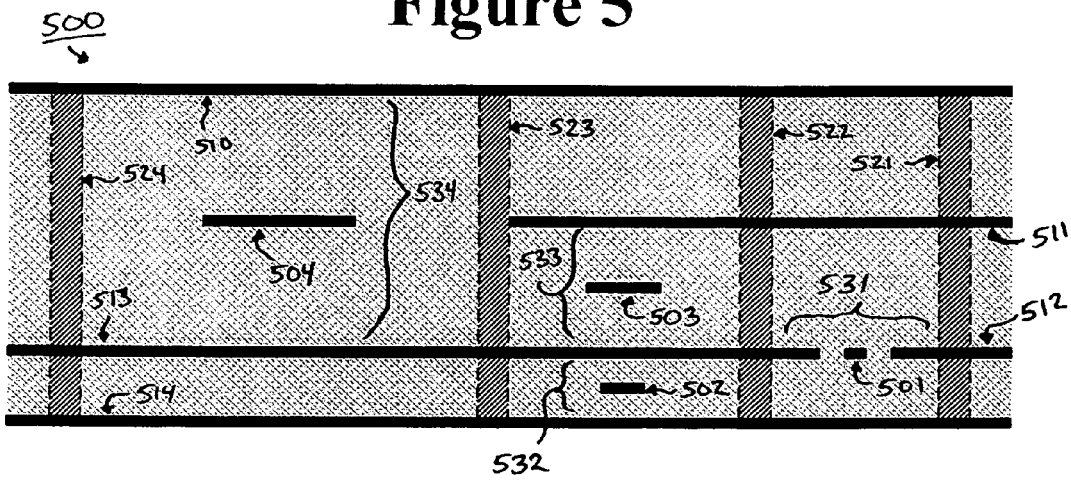
FIG. 5 illustrates in cross section several time delay lines in a mixture of high density interconnect stripline and coplanar waveguide configurations according to one embodiment of the present invention.

According to another embodiment of the present invention, a single time delay module may have some time delay lines implemented as coplanar waveguides, and other time delay lines implemented as high density interconnect striplines. According to one aspect of the present invention, CPW time delay lines may be configured to have a higher loss per unit length than HDI stripline time delay lines, making the CPW configuration better suited for use in shorter time delay lines. FIG. 5 is a partial view in cross section of an exemplary embodiment of the present invention, in which three longer time delay lines are implemented as HDI striplines and one shorter time delay line is implemented as a coplanar waveguide.

True time delay module 500 includes CPW time delay line 531 and HDI stripline time delay lines 532, 533 and 534. CPW time delay line 531 includes ground planes 512 and 513, which are grounded through via fences 521-524 to ground planes 510 and 514. Time delay line 531 further includes center conductor 501. HDI stripline time delay line 532 includes ground planes 513 and 514 and center conductor 502. HDI stripline time delay line 533 includes ground planes 511 and 513 and center conductor 503. HDI stripline time delay line 534 includes ground planes 510 and 513 and center conductor 504.

While the foregoing exemplary embodiments have been described with reference to transmission lines implemented as striplines and coplanar waveguides, the scope of the present invention is not limited to these arrangements. Rather, as will be apparent to one of skill in the art, the present invention has application to a number of other transmission line structures for use in a time delay module, such as, for example, microstrips, suspended striplines, triplate structures, and the like. According to various embodiments of the present invention, microstrips, suspended striplines and triplate structures may be used instead of, or in combination with, striplines and/or coplanar waveguide transmission lines.

According to one embodiment, a time delay module of the present invention includes a reference delay line such as reference delay line 103 illustrated in FIG. 1. A reference delay line provides a short path by which a signal can bypass the time delay lines with a minimal time delay (e.g., 10 ps), while still being passively amplitude compensated. According to one aspect of the present invention, a reference delay line may also be matched to the same level as the time delay lines of a time delay module. According to an additional aspect of the present invention, a reference delay line may be easily implemented either off-chip or on-chip, with either lumped elements or distributed elements.

According to one aspect of the present invention, a reference delay line such as reference delay line 103 may include a fixed attenuator. While such an arrangement may be suitable for narrowband applications, however, broadband applications require that the insertion loss of a reference delay line match the loss of the time delay lines over a broad range of operating frequencies. Thus, in accordance with another aspect of the present invention, a reference delay line such as reference delay line 103 may include a series resistor-inductor ("RL") network with an inductance and a resistance configured such that an insertion loss of the reference delay line is substantially the same as the insertion loss of the time delay lines of the same time delay module over a broad range of operating frequencies. Such a configuration is made possible by the different behaviors exhibited by resistors and inductors as the frequency of the signal passing through them changes. At lower frequencies, an inductor has lower reactance, so the resistance of the resistor dominates the circuit performance, resulting in a higher insertion loss. At higher frequencies, an inductor has higher reactance, so it tends to dominate circuit performance, resulting in higher insertion loss. Thus, through simple computer modeling, it is possible to select resistance and inductance values that will provide an insertion loss v. frequency curve that is substantially the same as that of the time delay lines of the same time delay module.

For example, according to the exemplary experimental embodiment described above with reference to Table 1, a lumped-element reference delay line includes a 30 ohm resistor and a 1.2 nH inductor in series (or, equivalently, a series of resistors and inductors with a total resistance of 30 ohms and a total inductance of 1.2 nH). In this exemplary experimental embodiment, the insertion loss of the reference delay line varied from that of the time delay lines may vary by as little as ±1.0 dB over a range of operating frequencies from about 2 to about 18 GHz. This is further illustrated in FIG. 3, discussed in greater detail above, in which it is seen that a reference delay line ("TD0") of the present invention has an insertion loss that varies from that of the corresponding time delay lines by less than about ±1.0 dB in a range of operating frequencies from 2 to 18 GHz.

While the exemplary series RL network described above provides passive amplitude compensation over a broad range of operating frequencies, it may be difficult to configure such a series RL network to provide impedance substantially matched to the time delay lines. For example, the exemplary series RL network described above has a characteristic impedance of about 30 ohms. As the time delay lines may have a characteristic impedance of about 50 ohms, the voltage standing wave ratio ("VSWR") of about 1.6:1 provided by this exemplary series RL network is not ideal. Nevertheless, according to one embodiment of the present invention, the effects of this higher VSWR can be minimized by buffer networks included in the reference delay line.

Figure 6:
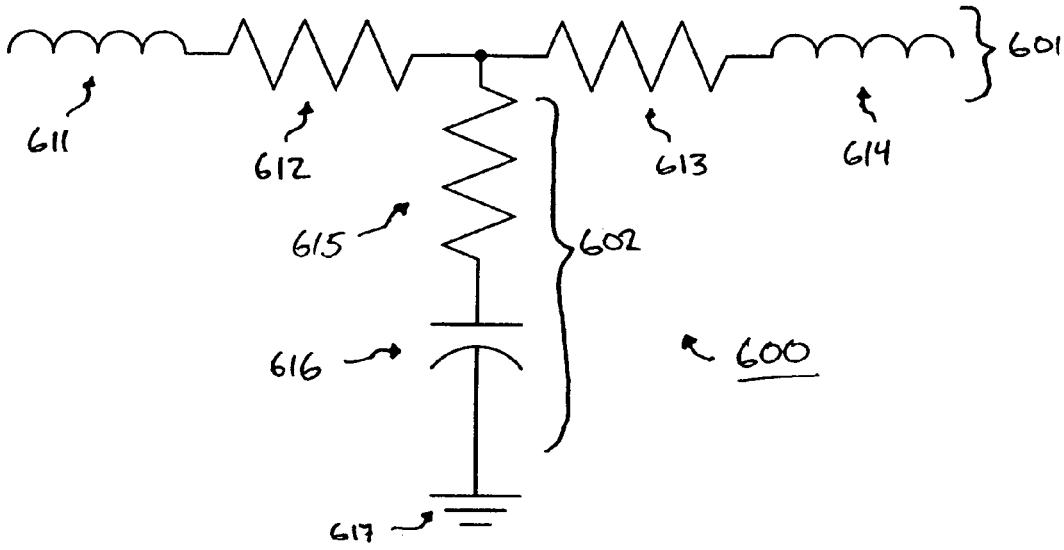
FIG. 6 illustrates a reference delay line implemented with lumped elements, according to one aspect of the present invention.

To reduce or even obviate the need for buffer networks, however, one or more resistor-capacitor ("RC") networks may be provided in shunt with a series RL network to provide a reference delay line with both broadband passive amplitude compensation and an improved impedance match, according to one aspect of the present invention. FIG. 6 illustrates an exemplary embodiment of such a reference delay line. Reference delay line 600 includes series RL network 601 and RC network 602 in shunt with RL network 601. RL network 601 includes inductors 611 and 614 and resistors 612 and 613. RC network 602 includes resistor 615 and capacitor 616, and is grounded to ground 617. By selecting appropriate resistances, inductances and capacitances for these components, not only can reference delay line 600 be configured such that the insertion loss for reference delay line 600 is substantially the same (e.g., varying by as little as ±1.0 dB) over a broad range of operating frequencies as the insertion loss of the time delay lines of the same true time delay module, but the characteristic impedance of reference delay line 600 can be configured to be within 50% of the characteristic impedance of the time delay lines as well.

For example, according to one experimental embodiment, RL network 601 was configured so that inductors 611 and 614 had an inductance of 0.23 nH, while resistors 612 and 613 had a resistance of 12 ohms. RC network 602 was configured so that resistor 615 had a resistance of 28 ohms and capacitor 616 had a capacitance of 0.28 pF. This configuration provided an insertion loss v. frequency curve substantially the same (e.g., within 1.0 dB) as that of the time delay lines in the same true time delay module, while maintaining a characteristic impedance within 50% of the characteristic impedance of the time delay lines (i.e., VSWR≦1.5).

According to an additional aspect of the present invention, a reference delay line such as reference delay line 600 is configured to reduce the variance in time delay experienced at different frequencies. For example, in the exemplary embodiment illustrated in FIG. 6, the delay variation experienced by reference delay line 600 from 2-18 GHz is less than 7 ps, with an average absolute delay of 8 ps. This delay variation, when compared to the next shortest time delay line (e.g., a time delay line with a delay of 330 ps), results in an error of less than about 2.5%.

Figure 7:
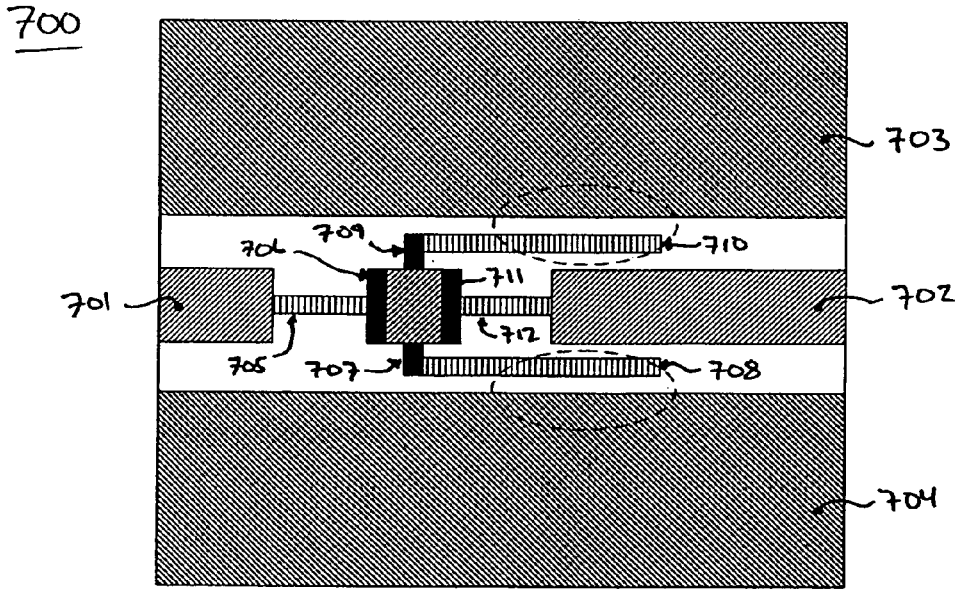
FIG. 7 illustrates a reference delay line implemented with distributed elements, according to another aspect of the present invention.

FIG. 7 illustrates a plan view of a reference delay line implemented with distributed elements, according to one embodiment of the present invention. Reference delay line 700 is implemented in a coplanar waveguide packaging. Reference delay line 700 includes both a series RL network and two RC networks in shunt with the series RL network. Ground planes 703 and 704 surround center conductors 701 and 702, which are connected by a series RL network. The series RL network includes inductor 705, resistors 706 and 711, and inductor 712. Inductors 705 and 712 are implemented with a high impedance section of transmission line. In shunt with this series RL network are two RC networks. One RC network includes resistor 709 and open circuit transmission line 710, which acts as a capacitor due to the small gap between it and ground plane 703. The other RC network includes resistor 707 and open circuit transmission line 708, which similarly acts as a capacitor due to the small gap between it and ground plane 704.

Figure 8:
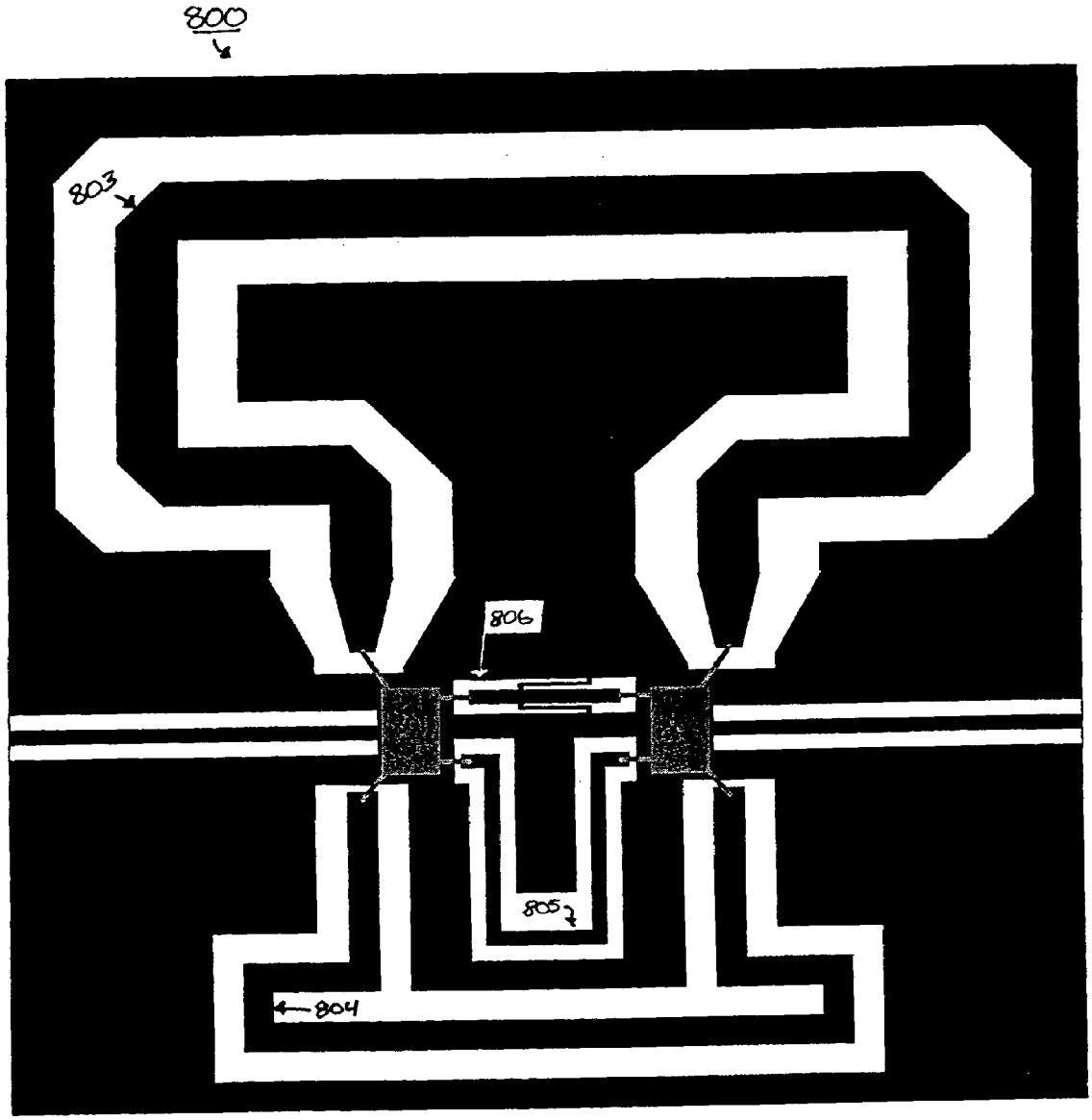
FIG. 8 illustrates a wideband passive amplitude compensated TTD system according to one embodiment of the present invention.

FIG. 8 illustrates a wideband passive amplitude compensated TTD system according to one embodiment of the present invention, in which the transmission lines are implemented as coplanar waveguides. TTD system 800 includes an input switch 801 and an output switch 802. TTD system 800 further includes a reference delay line 806 disposed between input switch 801 and output switch 802. TTD system 800 further includes time delay lines 803-805 between input switch 801 and output switch 802. As discussed in greater detail above, each one of time delay lines 803-805 has a different line length. Each of time delay lines 803-805 includes two corresponding ground planes and a center conductor between the two corresponding ground planes. Each center conductor has a width and is separated from the two corresponding ground planes by a gap space. For each of time delay lines 803-805, the width of the center conductor is configured such that a loss of the time delay line is substantially the same as a loss of every other time delay line over a range of operating frequencies. For each of time delay lines 803-805, the gap space is configured such that an impedance of the time delay line is substantially the same as an impedance of every other time delay line.

Figure 9:
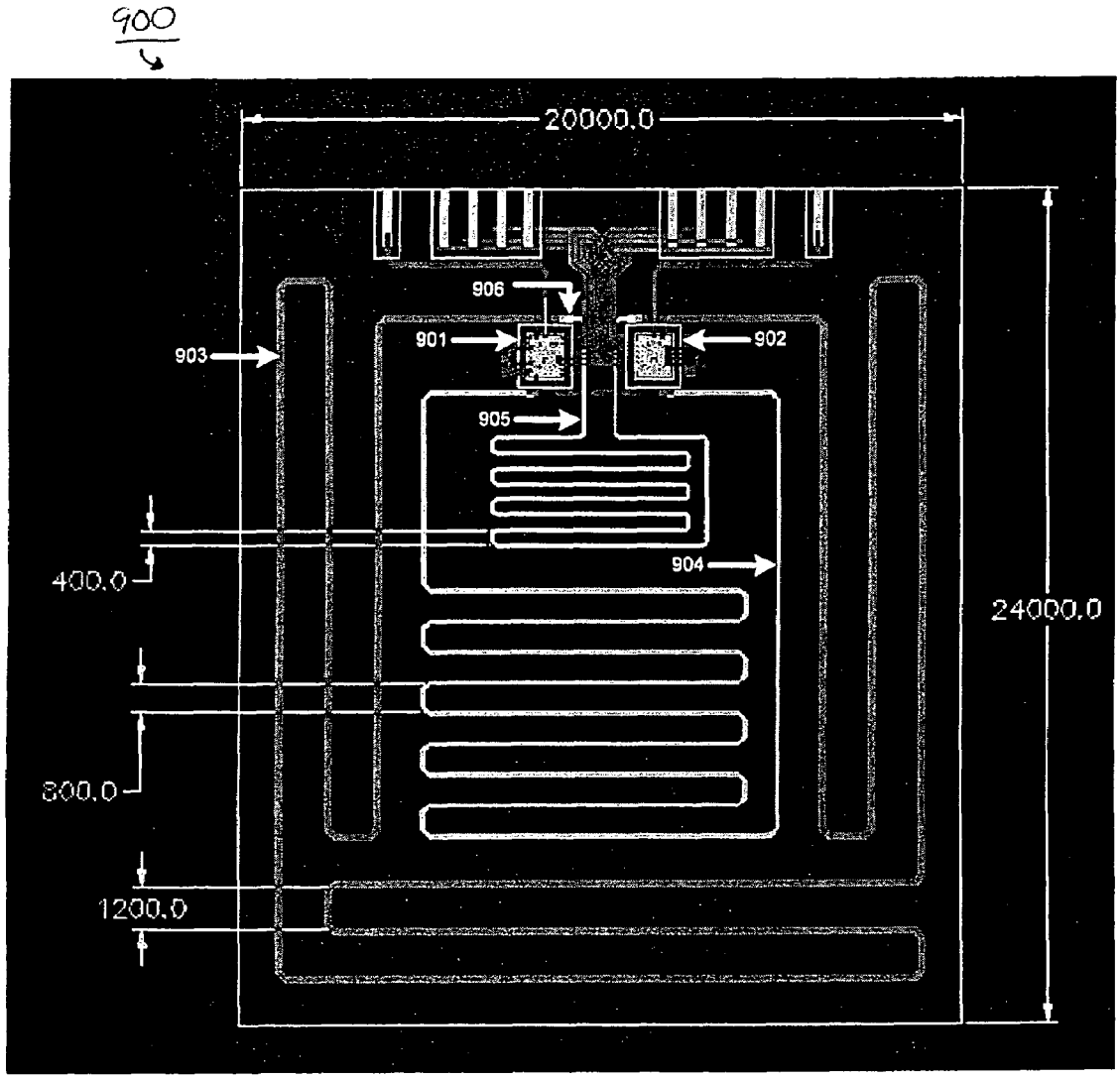
FIG. 9 illustrates a wideband passive amplitude compensated TTD system according to one embodiment of the present invention.

FIG. 9 illustrates a wideband passive amplitude compensated TTD system according to one embodiment of the present invention, in which the time delay lines are implemented as HDI striplines. TTD system 900 includes an input switch 901 and an output switch 902. TTD system 900 further includes a reference delay line 906 disposed between input switch 901 and output switch 902. TTD system 900 further includes time delay lines 903-905 between input switch 901 and output switch 902. As discussed in greater detail above, each one of time delay lines 903-905 has a different line length. Each of time delay lines 903-905 includes a center conductor between two corresponding ground planes. Each center conductor has a width and is separated from the two corresponding ground planes by a gap space. For each of time delay lines 903-905, the width of the center conductor is configured such that a loss of the time delay line is substantially the same as a loss of every other time delay line over a range of operating frequencies. For each of time delay lines 903-905, the gap space is configured such that an impedance of the time delay line is substantially the same as an impedance of every other time delay line.

Figure 10:
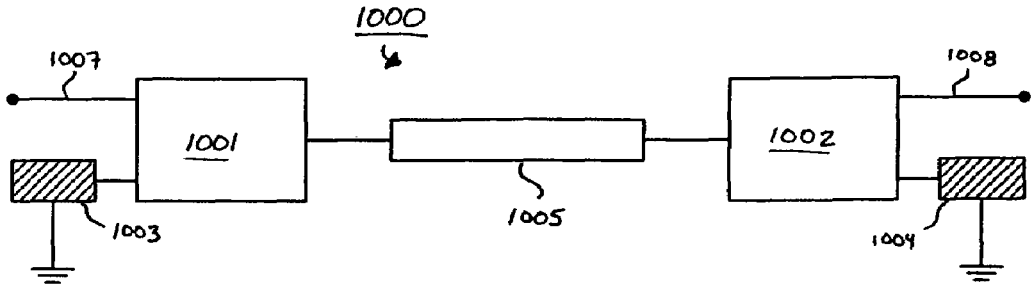
FIG. 10 illustrates a transmission line according to one aspect of the present invention.

An additional aspect of the present invention relates to the elimination of undesirable coupling between time delay states caused by periodic resonances on un-terminated transmission lines. When an open-circuited transmission line has a length that is a multiple of ½λ (where λ is the wavelength of a signal carried in the transmission line), multiple periodic resonances can occur in the line, creating a high-VSWR condition. To address this issue, in one embodiment of the present invention, a transmission line includes both input and output transfer switches and two terminating loads for terminating the transmission line when it is not in use. FIG. 10 illustrates one such transmission line. Transmission line 1000 includes an input transfer switch 1001, an output transfer switch 1002, and terminating loads 1003 and 1004. According to one aspect of the present invention, terminating loads 1003 and 1004 may be resistors, such as a 50 ohm lumped element resistor. According to alternate aspects, however, terminating loads 1003 and 1004 may be any type of terminating load known to those of skill in the art.

When transmission line 1000 is in use (i.e., when the true time delay system input switch selects transmission line 1000), input transfer switch 1001 accepts a signal from input port 1007, passes the signal through transmission line structure 1005 (e.g., a center conductor separated by ground planes, a series RL network, etc.) to output transfer switch 1002, which outputs the signal to output port 1008. When transmission line 1000 is not in use, however, input transfer switch 1001 and output transfer switch are configured to connect transmission line structure 1005 to both terminating loads 1003 and 1004. In this configuration, transmission line structure 1005 is effectively terminated, preventing unwanted coupling between time delay states due to the high VSWR condition that would otherwise be caused by periodic resonances in an un-terminated line.

As a result of their passive amplitude compensation true time delay modules of the present invention are suitable for use in a variety of applications where squint-free performance is important, such as space-based and high-altitude airship radars, multi-function airborne and ship-borne apertures, multi-frequency (e.g., C/X/Ku/Ka) commercial and MIL-Space communications phased arrays, wideband sensor arrays and the like. In addition, true time delay modules of the present invention are suitable for beamformers for a number of phased array applications, where a combination of wide instantaneous bandwidth and large scan angles are needed.

Figure 11:
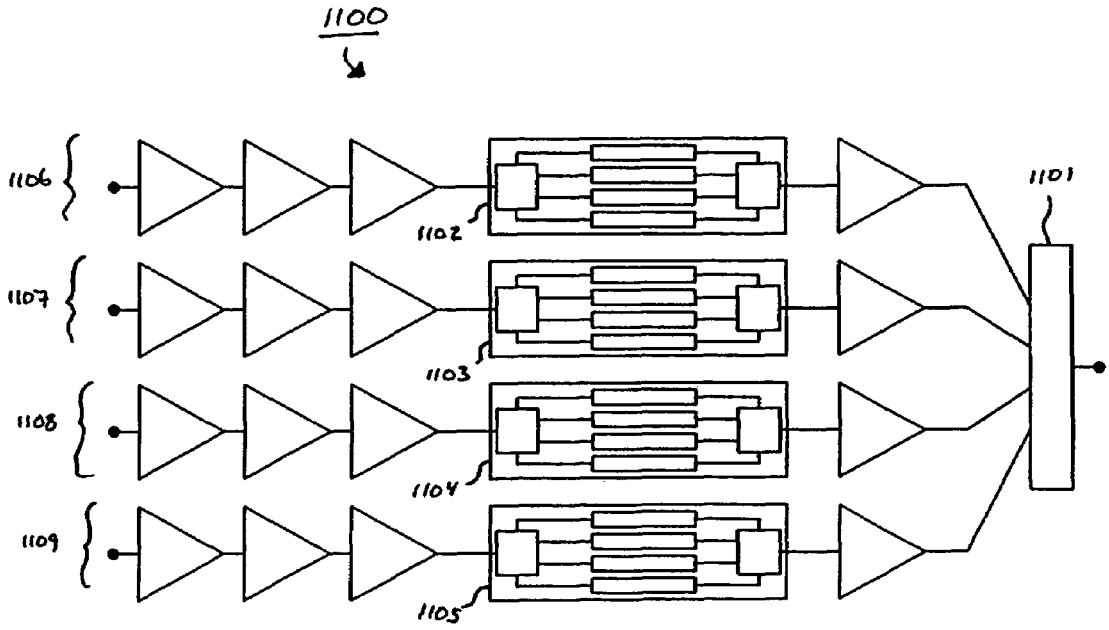
FIG. 11 illustrates a beamformer for wideband phased array applications according to one embodiment of the present invention.

FIG. 11 illustrates a beamformer for wideband phased array applications according to one embodiment of the present invention. Beamformer 1100 includes combiner 1101, TTD modules 1102-1105, and radiating element ports 1106-1109. While beamformer 1100 has been illustrated with four 2-bit TTD modules, the scope of the present invention is not limited to such an arrangement. Rather, as will be immediately apparent to one of skill in the art, a beamformer of the present invention may include any number of TTD modules, each of which may have any number of transmission lines, as illustrated in greater detail above.

While the present invention has been particularly described with reference to the various figures and embodiments, it should be understood that these are for illustration purposes only and should not be taken as limiting the scope of the invention. There may be many other ways to implement the invention. Many changes and modifications may be made to the invention, by one having ordinary skill in the art, without departing from the spirit and scope of the invention.

What is claimed is:

1. A true time delay system having passive amplitude compensation, the true time delay system comprising:

a multi-throw input switch;

a multi-throw output switch;

a reference delay line disposed between the multi-throw input switch and the multi-throw output switch; and a plurality of time delay lines disposed between the multi-throw input switch and the multi-throw output switch, each of the plurality of time delay lines having a different line length, each of the plurality of time delay lines including one or more corresponding ground planes and a center conductor having a different width and being separated from the one or more corresponding ground planes by one or more corresponding gap spaces, wherein, for each of the plurality of time delay lines, the width of the center conductor is configured such that a loss of the time delay line is substantially the same as a loss of every other time delay line over a range of operating frequencies, wherein, for each of the plurality of time delay lines, the gap space is configured such that an impedance of the time delay line is substantially the same as an impedance of every other time delay line.

2. The true time delay system of claim 1, wherein a first one of the plurality of time delay lines has a length $L_1$, a second one of the plurality of time delay lines has a length $L_2$, and $L_1>L_2$, wherein the center conductor of the first one of the plurality of time delay lines has a width $w_1$, the center conductor of the second one of the plurality of time delay lines has a width $w_2$, and $w_1>w_2$, and wherein a smallest one of the one or more gap spaces of the first one of the plurality of time delay lines is $s_1$, and a smallest one of the one or more gap spaces of the second one of the plurality of time delay lines is $s_2$, and $s_1>s_2$.

3. The true time delay system of claim 1, wherein one or more of the plurality of time delay lines is implemented as a stripline, a coplanar waveguide, a microstrip, a suspended stripline, or a triplate.

4. The true time delay system of claim 1, wherein a first one of the plurality of time delay lines is implemented as a stripline, a coplanar waveguide, a microstrip, a suspended stripline, or a triplate, wherein a second one of the plurality of time delay lines is implemented as a stripline, a coplanar waveguide, a microstrip, a suspended stripline, or a triplate, and wherein the first one and the second one do not share a same implementation.

5. The true time delay system of claim 1, wherein the reference delay line is implemented as a stripline, a coplanar waveguide, a microstrip, a suspended stripline, or a triplate.

6. The true time delay system of claim 1, wherein, for each of the plurality of time delay lines, the one or more corresponding ground planes and the center conductor are disposed in parallel planes.

7. The true time delay system of claim 1, wherein one or more of the plurality of time delay lines share a common ground plane.

8. The true time delay system of claim 1, wherein, for each of the plurality of time delay lines, the center conductor is separated from the one or more corresponding ground planes by one or more layers of a dielectric material.

9. The true time delay system of claim 8, wherein, for each of the plurality of time delay lines, the center conductor is disposed in a layer of adhesive between adjacent ones of the layers of the dielectric material.

10. The true time delay system of claim 1, wherein, for each of the plurality of time delay lines, the one or more corresponding ground planes and the center conductor are disposed in a single plane.

11. The true time delay system of claim 1, wherein, for each of the plurality of time delay lines, the one or more corresponding ground planes include at least two ground planes, and the at least two ground planes are commonly grounded to one or more stripline grounds through one or more via fences.

12. The true time delay system of claim 1, wherein each of the plurality of time delay lines further includes an input transfer switch, an output transfer switch, and two terminating loads for terminating the time delay line.

13. The true time delay system of claim 1, wherein, for each of the plurality of time delay lines, the loss of the time delay line is within 1.0 dB of the loss of every other time delay line from 2 GHz to 18 GHz.

14. The true time delay system of claim 1, wherein, for each of the plurality of time delay lines, the impedance of the time delay line is within 10% of the impedance of every other time delay line.

15. The true time delay system of claim 1, wherein the reference delay line includes a series resistor-inductor network with an inductance and a resistance configured such that a loss of the reference delay line is substantially the same as the losses of the plurality of time delay lines over the range of operating frequencies.

16. The true time delay system of claim 15, wherein the loss of the reference delay line is within 1.0 dB of the loss of each of the plurality of tine delay lines from 2 GHz to 18 GHz.

17. The true time delay system of claim 15, wherein the reference delay line further includes a series resistor-capacitor network in shunt with the resistor-inductor network.

18. A true time delay system having passive amplitude compensation, the true time delay system comprising:

a multi-throw input switch;

a multi-throw output switch;

a zero delay line disposed between the multi-throw input switch and the multi-throw output switch; and a plurality of time delay lines disposed between the multi-throw input switch and the multi-throw output switch, each of the plurality of time delay lines having a different line length, each of the plurality of time delay lines including two corresponding ground planes and a center conductor between the two corresponding ground planes, each center conductor having a different width and being separated from the two corresponding ground planes by a gap space, wherein, for each of the plurality of time delay lines, the width of the center conductor is configured such that a loss of the time delay line is substantially the same as a loss of every other time delay line over a range of operating frequencies, wherein, for each of the plurality of time delay lines, the gap space is configured such that an impedance of the time delay line is substantially the same as an impedance of every other time delay line.

19. A beamformer for wideband phased array applications comprising:

at least one true time delay module with passive amplitude compensation, the at least one true time delay module including:

a multi-throw input switch;

a multi-throw output switch;

a reference delay line disposed between the multi-throw input switch and the multi-throw output switch; and a plurality of time delay lines disposed between the multi-throw input switch and the multi-throw output switch, each of the plurality of time delay lines having a different line length, each of the plurality of time delay lines including two corresponding ground planes and a center conductor between the two corresponding ground planes, each center conductor having a different width and being separated from the two corresponding ground planes by a gap space, wherein, for each of the plurality of time delay lines, the width of the center conductor is configured such that a loss of the time delay line is substantially the same as a loss of every other time delay line over a range of operating frequencies, wherein, for each of the plurality of time delay lines, the gap space is configured such that an impedance of the time delay line is substantially the same as an impedance of every other time delay line.

* * * * *